United States Patent [19]

Brown

[11] Patent Number: 4,673,152

[45] Date of Patent: Jun. 16, 1987

[54] RECORD ALBUM DISPLAY AND SUPPORT SYSTEM

[76] Inventor: Paul A. Brown, Box 37 Surfside Colony, Surfside, Calif. 90743

[21] Appl. No.: 837,803

[22] Filed: Mar. 10, 1986

[51] Int. Cl.[4] ..... E04G 3/00

[52] U.S. Cl. ..... 248/216.1; 248/201; 248/488

[58] Field of Search ..... 248/201, 488; 40/124, 40/124.2, 605, 19.5, 10 R, 11 R, 606, 156, 158 A; 434/428, 430; 211/40

[56] References Cited

U.S. PATENT DOCUMENTS

| | | | |
|---|---|---|---|
| 1,238,988 | 9/1917 | Connor | 40/124 |
| 1,748,419 | 2/1930 | Hurley | 40/124 |
| 1,809,562 | 6/1931 | Nelson | 40/606 |
| 2,513,239 | 6/1950 | Hatchett | 40/19.5 X |
| 2,771,262 | 11/1956 | Laystrom | 248/216.1 X |
| 2,787,067 | 4/1957 | Nichols | 40/10 R X |
| 3,049,323 | 8/1962 | Peterka | 248/201 X |
| 3,913,289 | 10/1975 | Recker | 211/188 X |
| 4,179,089 | 12/1979 | Parr | 248/216.1 |
| 4,497,125 | 2/1985 | Hutchinson | 40/124 X |

FOREIGN PATENT DOCUMENTS

| | | | |
|---|---|---|---|
| WO81/01503 | 6/1981 | PCT Int'l Appl. | 248/488 |

*Primary Examiner*—J. Franklin Foss

*Attorney, Agent, or Firm*—Fulwider, Patton, Rieber, Lee & Utecht

[57] ABSTRACT

A system for displaying and supporting record albums on a wall. The system comprises a plurality of hangers secured by nails to the wall at points generally corresponding to the corners of the record albums. The corners of the record albums are removably received by the hangers.

6 Claims, 5 Drawing Figures

RECORD ALBUM DISPLAY AND SUPPORT SYSTEM

FIELD OF THE INVENTION

This invention relates to display systems and more particularly to a system for displaying and supporting record albums on a wall.

The system of this invention displays and stores a plurality of record albums on a preexisting wall. A particularly effective use of this system is to display, store and have ready for use record albums on a wall either in a residence or in a store selling record albums. The artwork on many record albums is of such quality as to invite display. It is also desirable to hold and support record albums in such a fashion as to avoid damage. In addition, it is desirable to have the record albums immediately available for play at any time without recourse to a cabinet or file.

Various display systems are shown in U.S. Pat. No. 4,497,125 and the patents identified therein. None of these prior art devices offer the utility of the system of the present invention at the low cost of manufacturer of such system.

SUMMARY OF THE INVENTION

A major object of the invention is to provide a low-cost record album display system capable of supporting and displaying a plurality of such albums on a wall.

A particular object of this invention is to provide a record album display system which allows essentially all of the front panel of an album to be displayed, but yet holds the album safely in position and ready for easy removal and reinsertion without damage to the album.

A particular object of the present invention is to provide a record album display system capable of securely holding albums upon a wall and thereby provide a decorative scheme for the wall, a storage capacity for the albums and a ready availability of the records for play.

It is another object of the present invention to provide a record album display system that supports the albums on a wall, yet allows a single album to be removed and reinserted without affecting adjacent albums in any way.

It is an additional object of the present invention to provide a record album display system wherein a plurality of albums may be stacked horizontally and attached to the wall to hold a number of the same albums in front of each other.

These and other objects of the present invention will become apparent from the following detailed description when taken in conjunction with the appended drawings.

DESCRIPTION OF THE PREFERRED EMBODIMENTS

Figure 3:
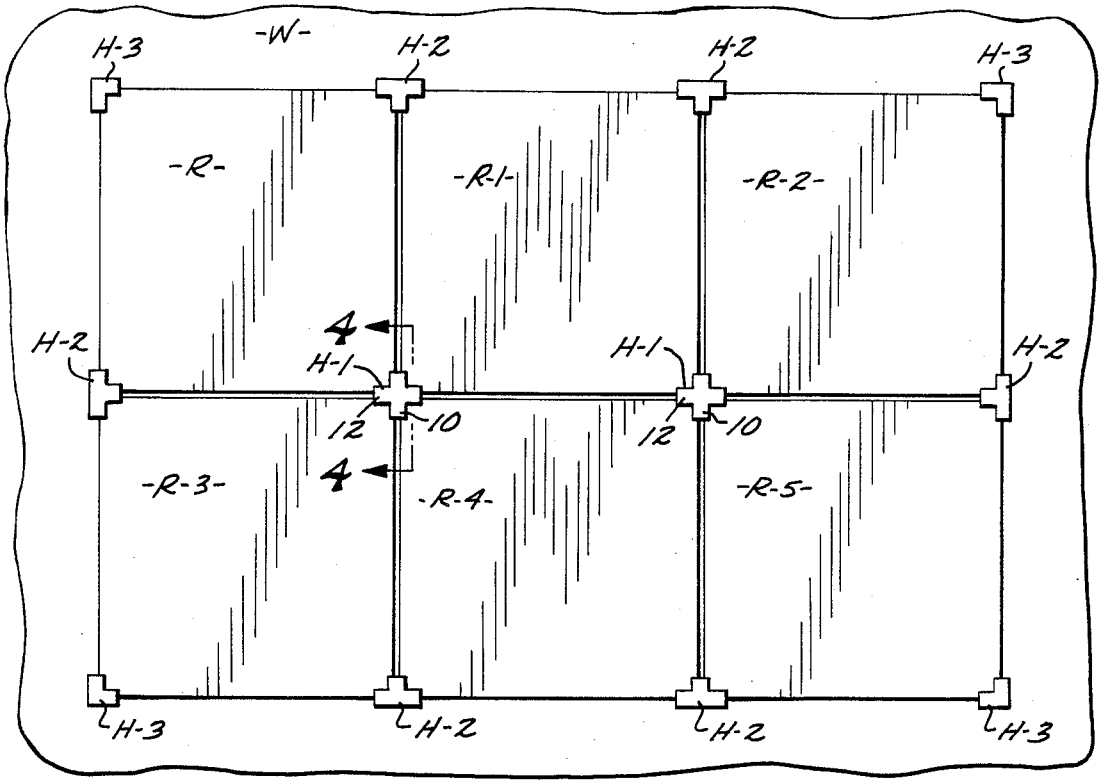
FIG. 3 is a front view in reduced scale of the record album display and support system of the present invention mounted upon a wall in an operative position.

Referring to the drawings, a preferred form of record album display and support system embodying the present invention is shown in FIG. 3. Such system includes a plurality of individual hanger members of three different configurations designated H-1, H-2 and H-3. Such hanger members are positioned on a wall W so as to display and removably support a plurality of conventional record albums R. The hangers designated H-1 are of cruciform configuration. The hangers designated H-2 are of T-shaped configuration, and the hangers designated H-3 are of generally L-shaped configuration.

Figure 1:
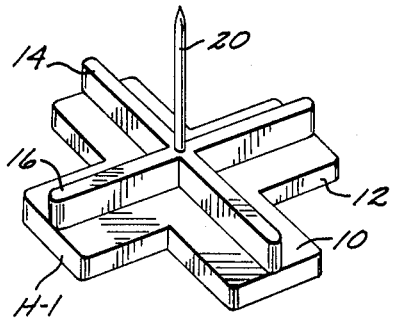
FIG. 1 is a rear perspective view of a preferred form of hanger utilized with the record album display and support system embodying the present invention.
Figure 2:
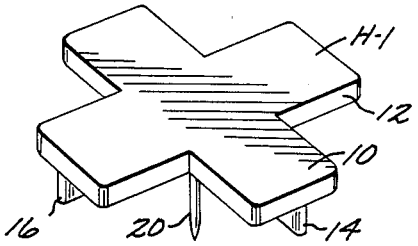
FIG. 2 is a front perspective view of said hanger.
Figure 4:
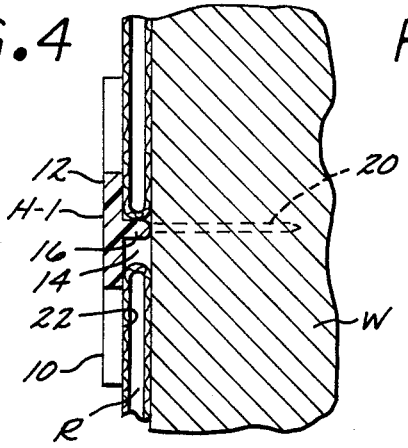
FIG. 4 is a vertical sectional view taken in enlarged scale along line 4—4 of FIG. 3.

More particulary, referring to FIGS. 1 and 2, there is shown the details of construction of the cruciform-shaped hangers H-1. Each such hanger includes a vertical leg 10 and a horizontal leg 12 normal thereto, the centers of which coincide. The legs 10 and 12 are flat and their vertical and horizontal legs are each formed with rearwardly extending spacer ribs 14' and 16', respectively, disposed along the mid-portion of their vertical and horizontal legs. In the form shown in FIGS. 1, 2 and 4, the height of the spacer ribs 14' and 16' is slightly greater than the depth of a record album R. The rear surfaces of the spacer ribs abut wall W.

Preferably, hangers H-1 are of integral construction and molded of a high density synthetic plastic. Other suitable materials, however, may be employed. A nail 20 associated with the hanger member S extends rearwardly from the center thereof, as shown particularly in FIG. 1. Such nail 20 serves to secure hanger H-1 to the wall W. Preferably, nail 20 will be integrally secured to its hanger during the molding of the latter.

Figure 5:
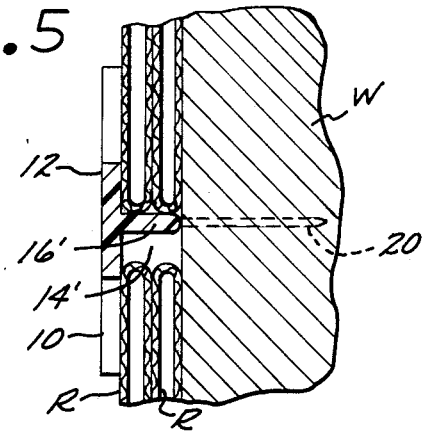
FIG. 5 is a view similar to FIG. 4, but showing a modification of said record album display and support system.

Referring now to FIG. 5, the spacer ribs 14' and 16' are shown as having a height slightly greater than the thickness of two or more record albums R, rather than the height of a single record album. Such arrangement increases the album supporting capacity of the system since two albums may be stacked between the hangers. Provisions for stacking more than two albums may be made by extending the height of the spacer ribs.

Referring again to FIG. 3, the hanger members H-2 are similar in construction to the cruciform-shaped hanger members H-1, except that they are of T-shaped configuration, eliminating the portion of the horizontal leg 16, outwardly of vertical leg 14. The hangers H-2, however, have the same spacer rib and nail arrangement utilized in hanger members H-1, with such nail extending inwardly from the mid portion of the vertical leg 14. The L-shaped hanger members H-3 are similar in construction to the cruciform-shaped hanger members H-1, except that one-half the horizontal leg 14 and one-half the vertical leg 16 are eliminated and nail 20 extends rearwardly from the intersection of the spacer ribs.

With continued reference to FIG. 3, the aforedescribed hanger H-1, H-2 and H-3 members are shown arranged to display and support six record albums R to R-5. Two cruciform-shaped hanger members H-1 are arranged at the center of the record album display area in horizontal alignment. Above each cruciform-shaped hanger member H-1 is arranged a T-shaped hanger member H-2, with the vertical leg pointing downwardly. T-shaped hanger members H-2 are arranged outwardly of each cruciform-shaped hanger member H-1 in horizontal alignment therewith, with their horizontal legs pointing inwardly. At the four corners of the record album display area there are arranged one of the L-shaped hanger members H-3, with the horizontal and vertical legs facing such area.

The record albums R to R-5 may be readily arranged within the display area by merely removably inserting their corners within the space 22 between the rear of the hanger legs and the wall W.

It should be noted that the record album display area FIG. 3 may be readily enlarged by the addition of more hanger members. By way of example, if the record album display area is to be increased towards the right-hand edge of that shown in FIG. 3, the right-hand hanger members would be moved to the right a distance approximating the width of a record album, with the L-shaped hanger member being replaced by a cruciform-shaped hanger member H-1, and the L-shaped hanger H-3 members being replaced by T-shaped hanger members H-2. It should also be noted that it is possible to provide a record album display area utilizing solely the cruciform-shaped hanger members H-1.

Various other modifications and changes may be made with respect to the foregoing detailed description without departing from the spirit of the present invention.

I claim:

1. A wall-mounted record album display and support system including at least four hanger members, each hanger member comprising:

vertical and horizontal leg means that are normal to one another and have coinciding centers;

a spacer rib extending rearwardly from the center of said legs into abutment with the wall, said spacer rib having a height slightly greater than the depth of a record album to be displayed to define a record album receiving space;

a nail secured to the hanger member to secure it to the wall; and with the four hanger members being positioned on the wall at points generally corresponding to the corners of a record album, said record album corners being removably inserted within said space.

2. A record album display and support system as set forth in claim 1 wherein said hanger members are molded of synthetic plastic and said nail is integrally secured to its hanger member during the molding process.

3. A record album display and support system as set forth in claim 1 wherein the height of the spacer ribs is a multiple of the depth of a record album to be displayed.

4. A record album display and support system as set forth in claim 1 wherein the hanger members are cruciform-shaped.

5. A record album display and support system as set forth in claim 1 wherein said system is made up of a combination of cruciform-shaped, T-shaped and L-shaped hangers.

6. A record album display and support system as set forth in claim 2 wherein said system is made up of a combination of cruciform-shaped, T-shaped and L-shaped hangers.

* * * * *